United States Patent [19]

Burgess

[11] Patent Number: 4,938,532

[45] Date of Patent: Jul. 3, 1990

[54] SEATING APPARATUS

[76] Inventor: Gerald N. Burgess, Anningsley Park, Ottershaw, Surrey, England

[21] Appl. No.: 296,117

[22] Filed: Jan. 11, 1989

[30] Foreign Application Priority Data

Jan. 12, 1988 [GB] United Kingdom ..... 8800571

[51] Int. Cl.[5] ..... A47C 3/00

[52] U.S. Cl. ..... 297/301; 297/291; 297/306

[58] Field of Search ..... 297/301, 306, 291, 300, 297/299, 239, 302, 303, 304

[56] References Cited

U.S. PATENT DOCUMENTS

| | | | |
|---|---|---|---|
| 2,147,958 | 2/1939 | Angers | 297/306 |
| 2,587,822 | 3/1952 | Corning . | |
| 2,672,922 | 3/1954 | Freund | 297/306 |
| 2,732,005 | 1/1956 | Corning . | |
| 2,810,428 | 10/1957 | Plese | 297/301 |
| 3,042,448 | 7/1962 | Hamilton | 297/301 |
| 3,136,580 | 6/1964 | Parrott | 297/304 |
| 3,224,807 | 12/1965 | Welch et al. | 297/304 |
| 3,552,796 | 1/1971 | Williams | 297/304 |
| 3,598,354 | 8/1971 | Williams | 297/304 |
| 3,788,586 | 1/1974 | McNally | 297/304 |
| 3,856,352 | 12/1974 | Jacobi, Sr. | 297/239 |
| 4,235,408 | 11/1980 | Sapper | 297/302 |
| 4,666,121 | 5/1987 | Choong et al. | 297/302 |
| 4,796,950 | 1/1989 | Mrotz, III et al. | 297/302 |

FOREIGN PATENT DOCUMENTS

| | | | |
|---|---|---|---|
| 3601302 | 8/1986 | Fed. Rep. of Germany | 297/300 |
| 1495505 | 9/1967 | France | 297/300 |
| 60338 | 12/1947 | Netherlands | 297/291 |
| 1161464 | 8/1969 | United Kingdom . | |
| 1229137 | 4/1971 | United Kingdom . | |
| 1495080 | 12/1977 | United Kingdom . | |

*Primary Examiner*—Peter R. Brown
*Assistant Examiner*—Brian K. Green
*Attorney, Agent, or Firm*—Diller, Ramik & Wight

[57] ABSTRACT

Seating apparatus comprising a seat support carrying a seat, a back element pivoted to said seat support which can articulate between forward and rearward positions in relation thereto, and torsion bar means extending between the back element and the seat support which resiliently bias said back element towards the forward position.

6 Claims, 2 Drawing Sheets

FIG. 3
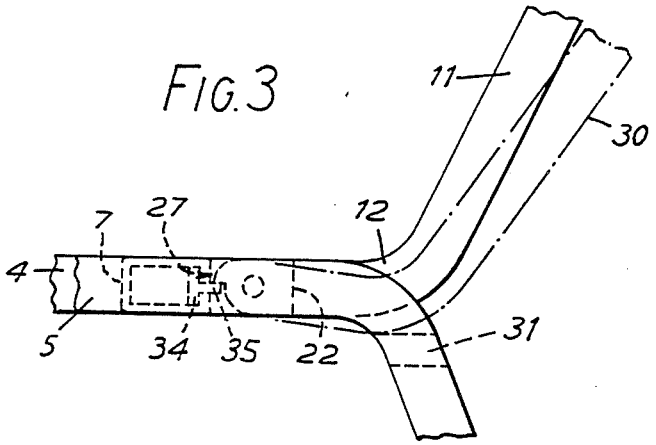
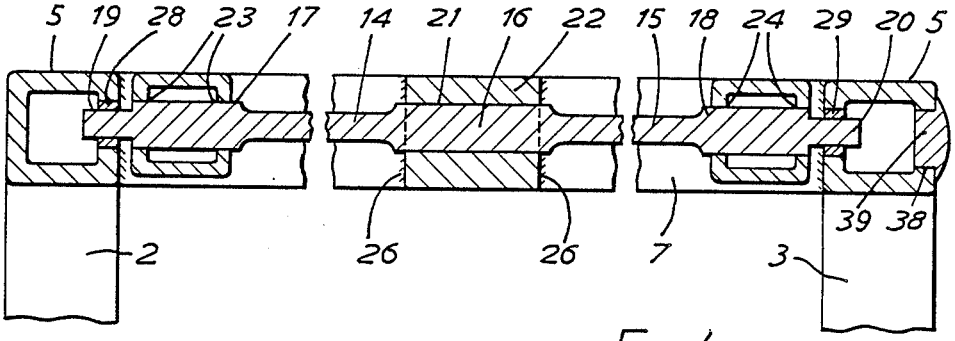
FIG. 4
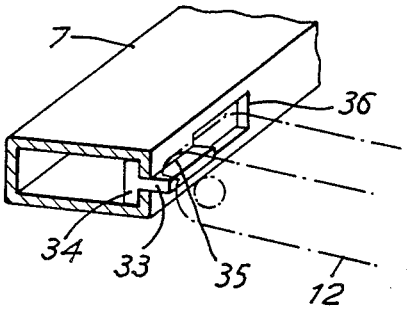
FIG. 5

SEATING APPARATUS

BACKGROUND OF THE INVENTION

This invention relates to seating apparatus which can be in the form of a seat, a chair, sofa or other appliance which is used for seating purposes.

It is known to provide seats and chairs with what is sometimes referred to as a swing back, that is, the back, or a portion of which against which the user's back or shoulders rests, can articulate in relation to the seat portion or its support under resilient control. The intention is to provide a more comfortable seating arrangement. It is also known with apparatus of this kind to provide the resiliency in the action by means of a torsion device, for example a torque bar or torsion spring. Previous constructions using this kind of device tend to be unsightly and/or bulky and, moreover, often employ a multiplicity of parts which renders them not only expensive to manufacture but unreliable and the present invention is intended to provide a seating apparatus construction of the above kind which overcomes the disadvantages set forth.

SUMMARY OF THE INVENTION

According to the present invention seating apparatus comprises a seat support carrying a seat, a back element pivoted to said seat support which can articulate between forward and rearward positions in relation thereto, and torsion bar means extending between the back element and the seat support which resiliently bias said back element towards the forward position.

The term "torsion bar means" is used herein to mean not only a solid bar but also laminated bars, tubes or other elements which can operate in this manner.

Preferably the torsion bar means are located on the pivotal axis of articulation and in a convenient construction the torsion bar means are provided with axially spaced apart ends which act as pivots for the back element.

This particular construction provides a very simple and neat assembly.

Preferably two co-axial torsion bars are provided and these may be formed by a single member which is secured to the seat support at a mid point.

The torsion bar may be made from an aluminium alloy such as a copper bearing alloy of the 7,000 series.

The construction set forth above is applicable for use with constructions in which the seat support and the back support are made from a lightweight material, for example aluminium or an aluminium alloy.

With this construction the back support and the seat support may be made from tube material, for example square tubing.

The invention is particularly although not exclusively applicable therefore for relatively lightweight stackable chairs and thus, the seat support may be shaped to allow the seating appliances to nest one above the other.

The invention can be performed in various ways but one embodiment will now be described by way of example and with reference to drawings in which:

BRIEF DESCRIPTION OF THE DRAWINGS

FIG. 3 is an enlarged part-view of the in FIGS. 1 and 2;

FIG. 4 is a part cross-sectional view of the manner of articulating the back support to the seat support looking in the direction of the arrow IV in FIG. 2; and, FIG. 5 is a part cross-sectional view showing the stop construction.

DESCRIPTION OF THE PREFERRED EMBODIMENTS

Figure 1:
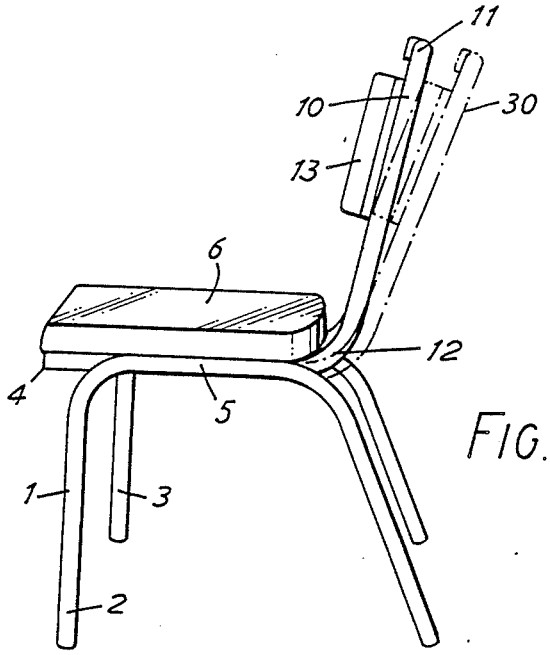
FIG. 1 is a side elevation of a stackable chair embodying the invention.

As shown in the drawings the seating apparatus is in the form of a stackable chair which is made from aluminium or aluminium alloy tubing of square cross-section. A seat support, indicated generally by reference numeral 1, comprises a pair of U-shaped legs 2 and 3 which are connected together by a U-shaped bracket 4 which extends between them, the bracket 4 being substantially horizontal and the legs 2 and 3 substantially vertical in the manner shown in FIG. 1. The dimensions of the legs 2 and 3 are arranged in known manner so that the chairs can nest one above the other to form a stack.

The upper rails 5 of each of the legs 2 and 3 are connected to the bracket 4 by welding and a seat 6 is mounted on the bracket 4 in any convenient manner. An additional box cross-section member 7 also extends between the upper rails 5 and is welded in position between them.

Figure 2:
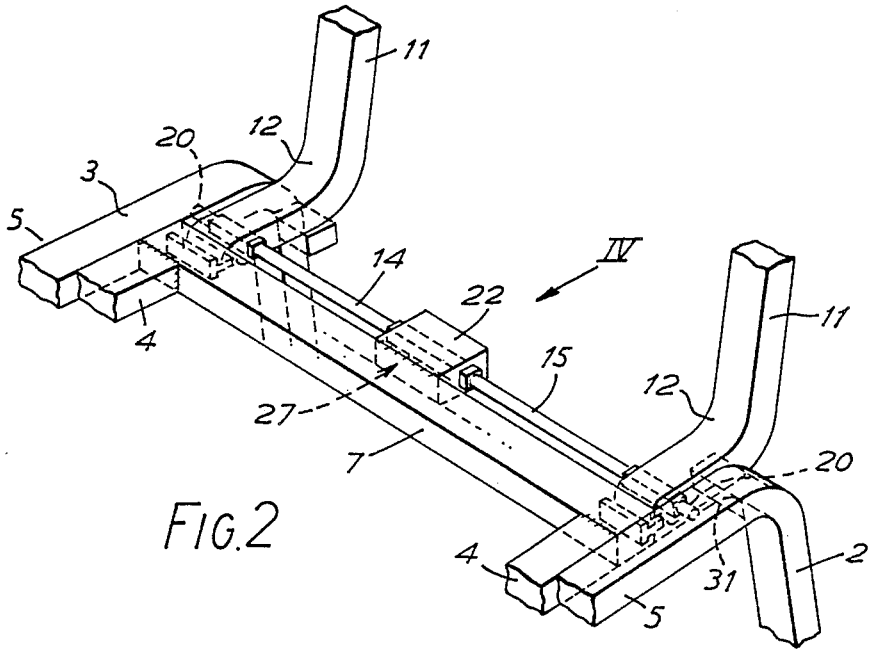
FIG. 2 is a part-view of the chair shown in FIG. 1 with the seat removed to disclose the connection between the back support and the seat support.

A back element indicated generally by reference numeral 10 comprises a further U-shaped frame 11, the lower ends 12 of which curve forward as is most clearly seen in FIG. 2. A padded back rest 13 spans the upper part of the U-shaped frame.

The lower ends 12 of the back element are engaged by a pair of torsion bars 14 and 15 which are formed from a single member made from a suitable aluminium alloy such as a copper bearing alloy of the 7,000 series. This member has a square center portion 16, circular cross-section portions each side of it which form the torsion bars 14 and 15, outer square section portions 17 and 18 and portions of circular cross-section 19 and 20 which act as pivots in the manner to be described. The central portion 16 is engaged with a force fit in a square section bore 21 in a mounting block 22 and the square section outer portions 17 and 18 are similarly engaged with a force fit in square bores 23 and 24 in the forward positions 12 of the back element. The mounting block 22 is welded to the cross member 7 as indicated by reference numeral 26. The front face 27 of the mounting block 22 may be chamfered (not shown) fore and aft to allow a predetermined loading to be applied to the back element in a manner to be described.

The pivot ends 19 and 20 of the torsion bar element are located in bearings 28 and 29 carried in suitable bores in the top rails 5 of the seat support members 2 and 3.

The seat support is assembled to the back element in the manner shown in FIG. 4 and so that the back element can pivot against the resilient effect of the torsion bars 14 and 15 between a forward position as indicated in FIGS. 1 and 3 and a rearward position as indicated in broken lines by reference numeral 30. Any chamfer on the front surface of the mounting block 22 is arranged so that when the block is secured in position it applies a pre-load to the torsion bars 14 and 15 urging the back element into the forward position. When a load is applied backwards against the back element it can move rearwardly against the resilient action of the torsion bars until it reaches a position where the lower surface of the lower ends 12 engage stops 31 secured to the rear legs and which act to limit the backwards movement.

Forward motion of the back element is limited by stops 33 in the form of T-section inserts 34 located in slots 35 in the cross member 7. The inserts are placed in position by passing them through enlarged openings 36. The forward surface of each of the lower ends 12 has a stepped abutment 37 which engages the appropriate insert 34 which therefore acts as a forward stop.

It will be appreciated that this construction provides a neat and simple appearance as the mechanism for controlling the back element is hidden beneath the seat 6.

If desired a suitably sized opening 38 can be provided in one of the upper rails 5 to enable the torsion bar to be inserted through the rail. With this arrangement the bearing 29 would have to be suitably dimensioned to allow a passage of the torsion bar before the bearing is located in place. The opening 38 can be closed by a plug 39 made, for example, from a plastics material.

The invention can be applied to seats in many other ways and if necessary the mechanism can be in other parts of the appliance, for example, the seat support can be provided with an upwardly projecting portion so that the pivoted back element rotates about a point vertically higher than the seat 6. It will also be appreciated that the invention can be applied to any form of seating apparatus in which it is desired to have a resiliently movable back element, for example a sofa but in this case it might be necessary to provide a series of co-axial torsion bars to carry the greater loadings.

I claim:

1. Seating apparatus comprising a seat support, back element pivotally connected to said seat support for pivoting movement between spaced apart forward and rearward positions, stop means mounted to and interacting between said seat support and said back element for limiting said pivoting at said forward and rearward positions, torsion bar means having axially spaced apart ends, said seat support being rigidly connected to said torsion bar means between said ends, said back element being rigidly connected to said torsion bar means at points spaced away from and on each side or said rigid connection to said seat support, said spaced apart and, of said torsion bar means pivotally connected to said seat support for effecting said pivoting movement between said back element and said support, and said torsion bar means being constructed and arranged for effecting resilient pivoting of said back element towards the rearward position when loaded and returning said back element to the forward position when unloaded.

2. Seating apparatus as claimed in claim 1 in which the torsion means are made from an aluminium alloy.

3. Seating apparatus as claimed in claim 1 in which the seat element and the back support are made from a light weight material.

4. Seating apparatus as claimed in claim 3 in which the seat support and the back support are made from tube material.

5. Seating apparatus as claimed in claim 4 in which the tube is square.

6. Seating apparatus as claimed in claim 1 in which the seat support is shaped to allow the seating apparatus to nest one above the other.

* * * * *